United States Patent [19]

De Forrest, Sr.

[11] Patent Number: 4,559,796

[45] Date of Patent: Dec. 24, 1985

[54] DOOR LOCK STATUS INDICATOR

[76] Inventor: William De Forrest, Sr., 1825 Via Burton, Anaheim, Calif. 92806

[21] Appl. No.: 578,973

[22] Filed: Feb. 10, 1984

[51] Int. Cl.[4] ..... E05B 41/00

[52] U.S. Cl. ..... 70/432; 70/434

[58] Field of Search ..... 70/432, 435, 434, 441

[56] References Cited

U.S. PATENT DOCUMENTS 3,427,835 2/1969 Jeffer ..... 70/432

FOREIGN PATENT DOCUMENTS 1119407 7/1968 United Kingdom ..... 70/432

OTHER PUBLICATIONS

Adams Rite Exit Indicator May, 1984.
Reflectolite Products Co. May, 1984.

*Primary Examiner*—Robert L. Wolfe
*Attorney, Agent, or Firm*—K. H. Boswell

[57] ABSTRACT

A status indicator for a door lock which is capable of being activated by a tail piece of the door lock has a first linking member which is operatively attached to the tail piece so as to be rotated by the tail piece and a second linking member which attaches between the first linking member and the indicating member. The second linking member translates the rotational movement of the first linking member to translational movement so as to move the indicating member linearly. The indicating member is housed within a housing plate which is attached to the door by the door lock. The indicating member moves within the housing member in response to change of the lock from a locked to an unlocked status and indicates this change so as to indicate the status of the lock, whether it is locked or unlocked.

12 Claims, 6 Drawing Figures

10
12
14
16
18
20
22
24
26
28
30
32
34
36
38
40
41
42
44
46
48
50
52
54
56
58
60
62
2
3

DOOR LOCK STATUS INDICATOR

BACKGROUND OF THE INVENTION

This invention is directed to a door lock status indicator for indicating either a locked or an unlocked position of a door lock on a door.

There is currently in use in bulidings of recent vintage certain aluminum frame doors which include an indicator mechanism showing whether the door is locked or unlocked. In the interest of public safety and the like it is desirable for other buildings, both old and new, and especially public buildings and the like to include such door lock status indicators on each of their locks. The presently known door lock status indicator is built in as a part of the aluminum door frame, and as such, to equip doors on public buildings with this door lock status indicator, it will be necessary to change the entire door and door frame. It is obvious that to have to change the entire door and door frame of all public buildings would represent a wasteful expenditure of the taxpayers money with regard to the same.

The presently known door lock status indicator utilizes a plate having a diagonally oriented slot therein with a pin which rides in this slot to raise or lower the plate. Many locks in common use would not be susceptible to be modified so as to interact with this known type of door lock status indicator.

In view of the above, it is evident that there exists a need for new and improved door lock status indicators which are capable of being incorporated on new doors as they are manufactured, but which, more importantly, are capable of being easily attached to existing door structures such that these door structures can indicate their locked or unlocked status.

BRIEF DESCRIPTION OF THE INVENTION

In view of the above, it is a broad object of this invention to provide new and improved door lock status indicators which are capable of being utilized both at the new manufacturing stage or as retrofits on existing door locks. Further, it is a broad object of this invention to provide a door lock status indicator which is capable of being positioned on either the inside or outside surface of the door, or on both of these surfaces, so as to indicate the status of the door lock on one, the other, or both sides of the door. Additionally, it is an object of this invention to provide door lock status indicators which can either be totally mechanical in their function or can be mechanical-electrical in their function.

These and other objects, as will become evident from the remainder of this specification, are achieved in a status indicator for a door lock of the type having a rotating member and a tail piece attaching to said rotating member so as to be rotated by said rotating member the status indicator which comprises: linking means operatively connected to said tail piece so as at least a first portion of said lining means is rotated by said tail piece in response to rotation of said rotating member and in response to rotation of at least said first portion of said linking means a second portion of said linking means being capable of movement between a first position and a second position; indicating means located on said door so as to be visible on said door, said indicating means operatively associated with said second portion of said linking means so as to be operated on by said second portion of said linking means, said indicating means for indicating a locked state of said door and an unlocked state of said door, said indicating means indicating said locked state in response to movement of said second portion of said linking means to one of said first or said second positions and said indicating means indicating said unlocked position in response to movement of said second portion of said linking means to the other of said first or said second positions.

Preferredly, the linking means would include a mechanism which is capable of changing rotational movement to translational movement such that rotation of the tail piece of the door lock is changed into linear movement of member attaching to the tail piece with the linear movement of the member controlling the indication of the locked or unlocked state of the door lock. In one embodiment of the invention, the linear movement would be totally mechanical, with indicia located on a member such that linear movement of the member exposes indicia indicative of either a locked state or indicia indicative of an unlocked state.

In a further embodiment of the invention, linear movement of the member would activate a switch such that a first electrical element is activated to indicate a locked state of the door lock and a second electrical element is activated to indicate an unlocked state of the door lock.

BRIEF DESCRIPTION OF THE DRAWINGS

The invention described in this specification will be better understood when taken in conjunction with the drawings wherein.

Figures 1, 2, 3, 4:
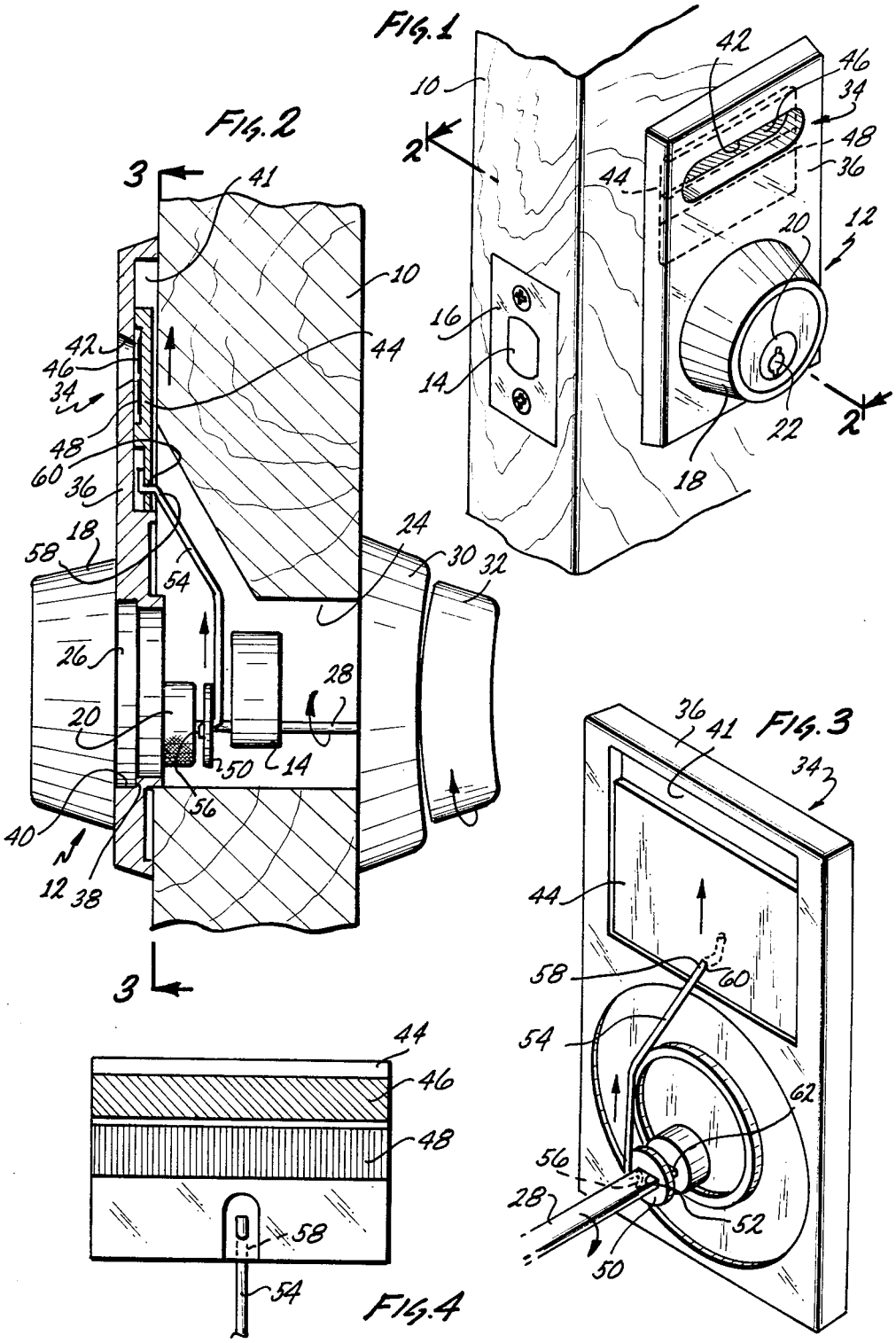
FIG. 1 is an isometric view of a first embodiment of the invention.
FIG. 2 is a side elevational view in partial section about the line 2—2 of FIG. 1.
FIG. 3 is an isometric view about the line 3—3 of FIG. 2.
FIG. 4 is a fragmentary elevational view of a portion of the invention seen in elevation in FIG. 2.

The invention described in this specification and shown in the drawings attached hereto utilizes certain principles and/or concepts as are set forth in the claims appended to this specification. Those skilled in the locksmith arts will realize that these principles and/or concepts are capable of being utilized in a variety of embodiments differing from the exact embodiments utilized for illustrative purposes herein. For this reason, this invention is not to be construed as being limited only to the illustrative embodiments, but is to be construed as being limited only by the claims.

DETAILED DESCRIPTION OF THE INVENTION

In FIG. 1 the portion of a door 10 which include a lock 12 is shown. The lock 12 is the type incorporating a bolt 14 which moves in and out of a guide plate 16. The lock 12 includes a cylindrical collar 18 and a cylinder 20. The cylinder 20 includes a keyhole 22 for a key. All of the components of the lock 12 are standard commercially available components.

Referring now to FIG. 2 it can be seen that the door 10 includes a recess 24 which houses certain components of the lock 12. Extending rearwardly from the body 26 of the lock 12 is the rear portion of the cylinder 20. Attaching to the rear portion of the cylinder 20 is a tail piece or driver bar 28. The tail piece 28 connects the cylinder 20 to other components of the lock 12 which are located on the inside of the door 10. These include a second cylindrical collar 30 and a knob 32 which is connected to the tail piece 28.

The cylinder 20 can be rotated by one of two mechanisms. The first is insertion of a key into the keyhole 22 with rotation of the cylinder by key. The second would be rotation of the tail piece 28 by rotation of the knob 32. This, in turn, would also rotate the cylinder 18 so as to move the bolt 14 to lock or unlock the door. In certain lock structures, two cylinders 20 would be utilized, one on the outside surface of the door and one on the inside surface of the door. These two locks require the use of a key from both the inside or outside of the structure to operate the bolt 14 to unlock the door and open the same. Whether or not two cylinders are used or one cylinder and a knob 32, as is illustrated in FIG. 2, is used, a tail piece 28 would connect between either the outside cylinder 20 and the knob 32 or the outside cylinder 20 and an identical inside cylinder, not numbered or shown, which would be located on the inside of the door. The tail piece 28 thus serves to communicate movement between one side of the door and the other.

In addition to communication of movement from one side of the door to the other, the tail piece 28 also serves to connect to the bolt 14 which locks or unlocks the door by appropriately extending or being retracted from the guide plate 16. All of these are common structures known in the locksmith arts.

The status indicator 34 of the invention is utilized on the door 10 in conjunction with the lock 12. The status indicator 34 includes a housing plate 36 which is placed against the surface of the door and held in place against this surface by the body 26 of the lock 12. The body 26 fits against a shoulder 38 formed in the housing plate 36. This shoulder 38 is formed in an opening 40 machined into the housing plate 36 so as to accept the body 26 of the lock 12. The housing plate 36 fits against the surface of the door 10 and completely surrounds the body 26 of the lock 12 such that once the lock is in place, it prevents removal of the housing plate 36.

The housing plate 36 has a recess 40 on its underneath side such that a voided space is formed between the outside surface of the door 10 and portions of the housing plate 36. A window 42 opens between the outside ambient environment and the recess 40. An indicator member 44 fits within the recess 40 with a portion of the indicator member 44 exposed through the window 42.

As can be seen in FIG. 4, the indicator member 44 includes a first indicia strip 46 located in one position and a second indicia strip 48 located in a further position. One or the other of these indicia strips 46 or 48 will be exposed out of the window 42 to indicate the status of the lock 12 whether it is locked or unlocked.

The indicator member 44 is movable upwardly or downwardly within the recess 40. As can be seen from FIG. 3, the recess 40 is rectilinear in shape with the indicator member 44 also being rectilinear in shape but of a slightly smaller dimension such that it is free to go up and down within the recess 40 but not side ways. The housing plate 36, in conjunction with the outside surface of the door 10 serves to form a compartment to contain the indicator member 44 allowing it to slide upwardly and downwardly in a vertical motion.

A tail piece member 50 has an elongated slot 52 formed therein which is slightly oversized with respect to the tail piece 28 such that the tail piece member 50 slides on to the tail piece 28 and is rotated in conjunction with rotation of the tail piece 28.

A linking member 54 connects between the tail piece member 50 and the indicia member 44. The tail piece member 50 includes a small opening, not separately numbered, which accepts end 56 of the linking member 54. The end 56 is shaped as a small crank so as to fit into the opening in the tail piece member 50, but allow for rotation of this end 56 within the opening in the tail piece member 50 but prevent dislodgement of the linking member 54 from the tail piece member 50.

The other end 58 of the linking member 54 is also shaped as a small crank such that it, too, can fit within an opening 60 formed in the indicating member 44. The interaction of the two ends 56 and 58 with the appropriate openings in the tail piece member 50 and the linking member 54 connects the tail piece member 50 through the linking member 54 to the indicator member 44.

In conjunction with rotation of the tail piece 28, the tail piece member 50 is also rotated. This moves the opening in the tail piece member 50 through an arcuate pathway and consequently also moves the end 56 of the linking member 54 in this arcuate pathway. The rotational movement of the end 56 of the linking member 54 is transferred by the linking member 54 into translational movement of its upper end 58 causing the indicator member 44 to slide up and down within the recess 40 in the housing plate 36. Thus, in response to rotation of the tail piece 28, the indicator member 44 moves upwardly or downwardly so as to expose one or the other of the indicia strips 46 or 48 through the window 42 to indicate the status of the lock 12 whether it is locked or unlocked.

It can be easily seen that a second of the status indicators 34 could be located on the inside of the door 10 in between the collar 30 and the inside surface of the door 10. As such, the status of the lock 12 whether it is locked or unlocked would be easily discernable from both the outside or the inside of the door 10.

The status indicator 34 is easily mounted to a door 10 on installation of the lock 12 to that door or can be easily retrofitted to an existing door 10 and lock 12 by simply withdrawing the lock and slipping the tail piece member 50 over the tail piece 28 and reassembling the lock with the status indicator housing plate 36 positioned between the collar 18 and the outside surface of the door. Since a typical tail piece 28 slides into a slot 62 as seen in FIG. 3, formed in the cylinder 20 and is only affixed at one of its ends, such as to the end not seen attaching to knob 32, there is sufficient length of the tail piece 28 to accommodate the additional thickness dimension of the housing plate 36 of the status indicator 34 upon retrofit of an existing lock.

Figure 5:
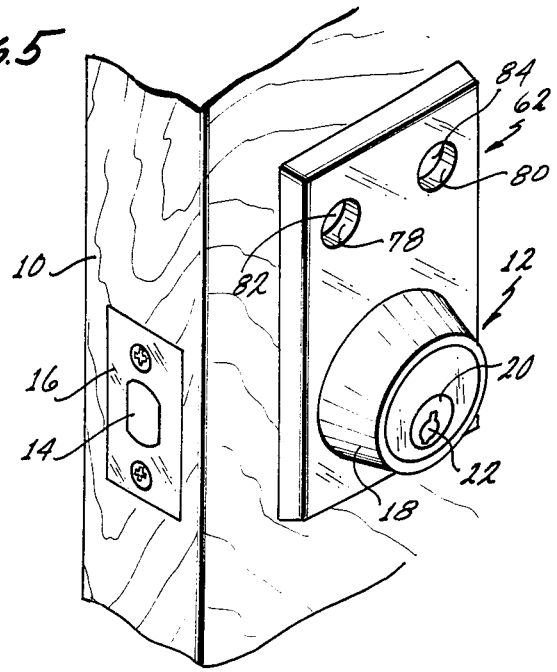
FIG. 5 is an isometric view of a further embodiment of the invention.
Figure 6:
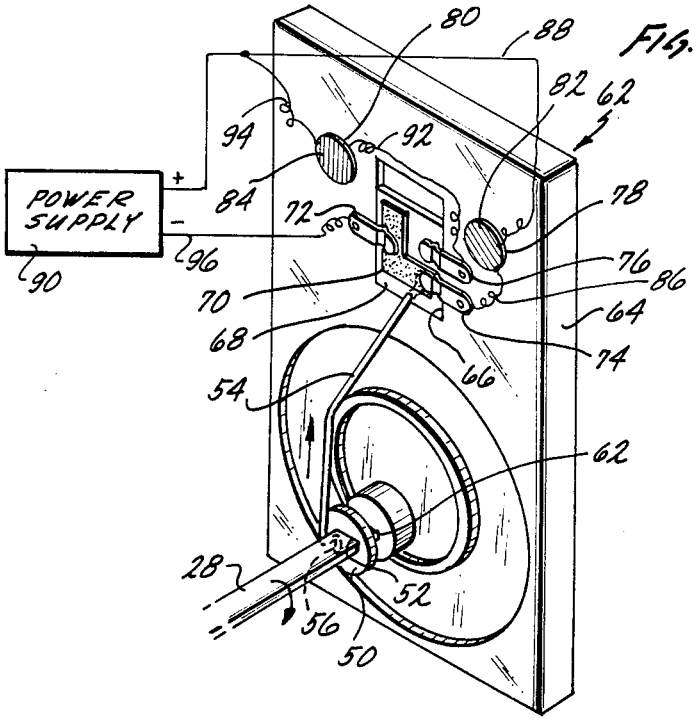
FIG. 6 is an isometric view of the back side of the embodiment seen in FIG. 5.

Referring now to FIGS. 5 and 6, an alternate status indicator 62 is shown. For FIGS. 5 and 6, the same door 10 and lock 12 are utilized and as such, like numerals are utilized. Furthermore, an identical tail piece 28 and linking member 54 are also utilized. The status indicator 62 differs from the status indicator 34 in that it utilizes electrical elements to indicate the locked or unlocked status, whereas the status indicator 34 utilized strictly mechanical elements, i.e., the indicia strips 46 and 48, to indicate the locked or unlocked status of the lock 12 on the door 10.

The status indicator 62 utilizes a housing plate 64 which is similar to the housing plate 36 except that its recess 66 is somewhat smaller than the recess in the housing plate 36. A sliding contact plate 68 formed of an insulating material is located in the recess 66 and can move upwardly and downwardly in that recess 66 under the influence of the linking member 54 in the same member as the indicator member 44 was moved upwardly and downwardly within the recess 40.

The contact plate 68 carries an "L" shaped electrical conducting surface 70 on its back side. Three electrical contact fingers, 72, 74 and 76, extend over the contact surface 70 with the contact finger 72 always in electrical contact with the surface 70 and the fingers 74 and 76 alternating between a contact state and an insulated state with respect to the conducting surface 70. As the contact plate 68 slides upwardly and downwardly, the long side of the surface 70 is always maintained in electrical contact with the finger 72. The short, or right hand side, of the surface 70, however, will only contact the finger 74 when the plate 68 is depressed within the recess 66 and will only contact the finger 76 when the plate 68 is elevated within the recess 66. Thus, alternately, an electrical bridge is formed between the finger 72 and either the finger 74 or the finger 76.

As opposed to the housing plate 36, the housing plate 64 does not include a window which extends from the ambient to the recess 66, but instead includes two windows 78 and 80 in which are inserted LED's 82 and 84. Thus, the LED's 82 and 84 are exposed on the outside surface of the housing plate 64. The LED 82 is connected via electrical lead 86 to the finger 74 and further by electrical lead 88 to a power supply 90. The LED 84 is connected via electrical lead 92 to the contact finger 76 and via electrical lead 94 to the power supply 90. A circuit is completed from the power supply 90 via electrical lead 96 to the contact finger 72.

When the contact plate 68 is in a depressed state, as is seen in FIG. 6, an electrical circuit would be completed via the power supply 90 to contact finger 72 and contact finger 74 to LED 82. When the contact plate 68 is elevated, an electrical circuit would be completed via the power supply 90 through contact finger 72 and contact finger 76 to LED 84. Thus, one or the other of the LED's 82 or 84 would be illuminated to indicate either the locked or unlocked state of the lock 12 to which the status indicator 62 is attached.

The power supply 90 could be mounted on the door 10 in direct association with the status indicator 62 and include appropriate batteries or the like, or it could be a transformer or the like which is appropriately connected to an outside electrical source with the leads 88, 94 and 96 traversing between the power supply 90 across the surface of the door 10 or in the interior of the door 10 to the status indicator 62.

While LED's 82 and 84 are utilized for indicating the locked and unlocked state of the status indicator 62, other appropriate electrical appliances, such as small tungsten filament light bulbs, or fluorescent bulbs could be utilized in their stead. Further, a single element, such as a multi-colored LED which would be capable of producing both a first and second electrical output could be utilized to indicate the locked or unlocked status of the lock 12. Of course, if a status indicator 62 was utilized both on the interior and the exterior of the door 10, the appropriate LED's 82 and 84, or other equivalent elements would be present on both an inside set and an outside set, with the sets connected in parallel to one another such that the status of the lock 12 could be ascertained from both sides of the door.

I claim:

1. A status indicator for a door lock of the type having a rotating member and a tail piece attaching to said rotating member so as to be rotated by said rotating member the status indicator which comprises:

linking means operatively connected to said tail piece so as at least a first portion of said linking means is rotated by said tail piece in response to rotation of said rotating member and in response to rotation of at least said first portion of said linking means a second portion being capable of movement between a first position and a second position;

indicating means located on said door so as to be visible on said door, said indicating means operatively associated with said second portion of said linking means so as to be operated on by said second portion of said linking means, said indicating means for indicating a locked state of said door and an unlocked state of said door, said indicating means indicating said locked state in response to movement of said second portion of said linking means to one of said first or said second positions and said indicating means indicating said unlocked state of said door in response to movement of said second portion of said linking means to the other of said first or said second positions;

said linking means includes a rotational to translational moving means operatively interspaced between said tail piece and said indicator means so as to be rotated by said tail piece and in response to said rotating producing a translational movement, said indicator means in response to said translational movement moving between said first and said second positions;

said linking means includes a tail piece member operatively connected to said tail piece so as to be rotated by said tail piece in response to rotation of said rotating member;

said linking means further including a linking member having ends, the first of said ends of said linking member operatively connected to said tail piece member so as to be moved in an arcuate pathway in response to rotation of said tail piece member, the second of said ends of said linking member moving linearly in response to arcuate movement of said first end.

2. The status indicator of claim 1 wherein:

said indicating means includes a housing member and an indicator member, said housing member mounted on said door in association with said door lock, said indicator member slidably mounted on said housing member so as to be moved on said housing member in response to said linear movement of said linking member;

said indicator member moving on said housing member between an unlocked indicating position and a locked indicating position.

3. The status indicator of claim 2 wherein:

said housing member includes a window, said indicator member located with respect to said housing member such that a variable portion of said indicator member is exposed through said window;

said indicator member including locked indicia and unlocked indicia located thereon, said indicia exposed through said window when said indicator member is in said locked position, said unlocked indicia exposed through said window when said indicator member is in said unlocked position.

4. The status indicator of claim 1 wherein:

said tail piece member includes a connector means located on said tail piece member radially displaced outwardly from the axis of rotation of said tail piece, said first end of said linking member pivotally connecting to said connector means.

5. The status indicator of claim 4 wherein:

said connector means comprises an opening in said tail piece member;

said first end of said linking member including a crank pin means sized and shaped so as to fit into and rotate within said opening in said tail piece member.

6. The status indicator of claim 5 wherein:

said indicating means includes a housing member and an indicator member, said housing member mounted on said door in association with said door lock, said indicator member slidably mounted on said housing member and operatively connected to said linking member so as to be moved on said housing member in response to said linear movement of said linking member;

said indicator member moving on said housing member between an unlocked indicating position and a locked indicating position.

7. The status indicator of claim 6 wherein:

said indicator member includes a further opening located therein;

said second end of said linking member sized and shaped so as to fit within said further opening to connect said linking member to said indicator member.

8. The status indicator of claim 7 wherein:

said housing member includes a window, said indicator member located with respect to said housing member such that a variable portion of said indicator member is exposed through said window;

said indicator member including locked indicia and unlocked indicia located thereon, said locked indicia exposed through said window when said indicator member is in said locked position, said unlocked indicia exposed through said window when said indicator member is in said unlocked position.

9. The status indicator of claim 8 wherein:

said housing member includes an outward face and an inward face, said inward face fitting against said door;

said inward face including a recess located therein, said recess sized and shaped so as to be of a greater size than said indicator member and shaped so as to contain said indicator member;

said indicator member located in said recess and slidably movable in said recess between said unlocked and said locked positions;

said window extending between said recess and said face surface so as to expose said locked and said unlocked indicia of said indicator member through said face surface.

10. The status indicator of claim 9 wherein:

said housing member further includes a lock opening, said lock opening accepting a portion of said door lock such that said housing member is mounted on said door in association with said door lock with said portion of said door lock passing through said housing member and with a further portion of said door lock maintaining said housing member against the surface of said door.

11. The status indicator of claim 1 wherein:

said second portion of said linking means includes switch means having a first position and a second position;

said indicating means includes an electrical indicating means and a circut means, said circuit means supplying electrical power to said electrical indicating means;

said electrical indicating means having a first indicating element and a second indicating element, both said first and said second indicating elements electrically connected to said switch means with said first indicating element energized when said switch means is in said first position and said second indicating element energized when said switch means is in said second position.

12. The status indicator of claim 11 wherein:

said first and said second electrical indicator means comprise a first and second LED, said first LED for indicating said unlocked position of said door, said second LED for indicating said locked position of said door.

* * * * *